US005715846A

United States Patent [19]

Kim

[11] Patent Number: 5,715,846

[45] Date of Patent: *Feb. 10, 1998

[54] HAIR CURLER

[75] Inventor: Hyeong Sook Kim, Kowloon, Hong Kong

[73] Assignee: Georg Wiegner, Kowloon, Hong Kong

[ * ] Notice: The term of this patent shall not extend beyond the expiration date of Pat. No. 5,538,021.

[21] Appl. No.: 554,594

[22] Filed: Nov. 6, 1995

Related U.S. Application Data

[63] Continuation-in-part of Ser. No. 284,095, Aug. 1, 1994, Pat. No. 5,538,021.

[30] Foreign Application Priority Data

Aug. 9, 1993 [DE] Germany ..... 9311823 U

[51] Int. Cl.[6] ..... A45D 2/00

[52] U.S. Cl. ..... 132/222; 132/226; 132/245; 132/262; 132/210

[58] Field of Search ..... 132/222, 226, 132/245, 262, 210

[56] References Cited

U.S. PATENT DOCUMENTS

| | | | |
|---|---|---|---|
| Re. 27,033 | 1/1971 | Mitsumoto . | |
| T871,005 | 2/1970 | Freeman . | |
| 1,718,025 | 6/1929 | Bishinger . | |
| 1,994,099 | 3/1935 | Fulton | 132/222 |
| 2,166,386 | 7/1939 | Auster . | |
| 2,171,885 | 9/1939 | Michael . | |
| 2,331,065 | 11/1943 | Willat . | |
| 2,404,517 | 7/1946 | Molchan . | |
| 2,631,593 | 3/1953 | Madore | 132/222 |
| 2,708,941 | 5/1955 | Field . | |
| 2,747,585 | 5/1956 | Allen et al. . | |
| 2,825,344 | 3/1958 | Lenois . | |
| 2,838,053 | 6/1958 | Zimmerman . | |
| 2,874,706 | 2/1959 | Ficicchy . | |

(List continued on next page.)

FOREIGN PATENT DOCUMENTS

| | | |
|---|---|---|
| 0 197 208 | 4/1985 | European Pat. Off. . |
| 0 460 452 A1 | 5/1991 | European Pat. Off. . |
| 1 247 508 | 11/1959 | France . |
| 1 404 587 | 5/1964 | France . |
| 2 382 212 | 3/1978 | France . |
| 2 503 996 | 4/1982 | France . |
| 2 615 079 | 11/1988 | France . |
| 17 93 426 | 2/1959 | Germany . |
| 14 57 375 | 3/1969 | Germany . |
| 15 57 333 | 1/1972 | Germany . |
| 23 38 330 | 2/1975 | Germany . |
| 75 05 892 | 10/1975 | Germany . |
| 24 26 028 | 12/1975 | Germany . |
| 26 22 364 | 12/1976 | Germany . |
| 28 07 979 | 2/1978 | Germany . |
| 20 02 226 | 2/1979 | Germany . |
| 30 05 837 | 9/1980 | Germany . |
| 3 309 241 | 3/1983 | Germany . |

(List continued on next page.)

*Primary Examiner*—Gene Mancene
*Assistant Examiner*—Pedro Philogene
*Attorney, Agent, or Firm*—Steven F. Caserza; Flehr Hohbach Test Albritton & Herbert LLP

[57] ABSTRACT

A hair curler which exhibits a winding member with an increasable diameter using a flag-shaped length is rolled up together with a lock of hair providing after each turn a winding member with an increased diameter depending on the thickness of the flag-shaped length and the lock of hair in-between. The number of turns can be chosen in line with a user's hair length and the desired hair curler diameter. The flag-shaped length is rolled onto the winding member together with a lock of hair increasing the winding member diameter depending on the length of the flag-shaped length and the number of turns rolled onto the winding member. Good retaining force of the curler is achieved by use of a self-gripping tape having projecting hooks, pins or bristles, which are preferably formed by cut-open loops of a nylon monofilament, thus resulting in hooks. The hooks may be deformed to mushroom-like bristles by heat process.

10 Claims, 2 Drawing Sheets

U.S. PATENT DOCUMENTS

| | | | |
|---|---|---|---|
| 2,941,534 | 6/1960 | Otto et al. . | |
| 2,972,994 | 2/1961 | Ferens . | |
| 3,045,685 | 9/1962 | Cormier . | |
| 3,105,502 | 10/1963 | Mitchell . | |
| 3,106,213 | 10/1963 | Clare . | |
| 3,123,080 | 3/1964 | Albertoni . | |
| 3,204,646 | 9/1965 | Chamberlin . | |
| 3,267,942 | 8/1966 | Mestral | 132/262 |
| 3,326,222 | 6/1967 | Rosenheim . | |
| 3,388,709 | 6/1968 | Morris . | |
| 3,530,863 | 9/1970 | Foster | 132/222 |
| 3,666,915 | 5/1972 | De Napoli . | |
| 3,700,853 | 10/1972 | Jensen et al. . | |
| 3,759,271 | 9/1973 | Caruso . | |
| 3,812,866 | 5/1974 | Morane . | |
| 3,881,500 | 5/1975 | Shinbashi et al. . | |
| 3,923,068 | 12/1975 | Gilman . | |
| 3,943,946 | 3/1976 | Gallegos | 132/222 |
| 4,298,787 | 11/1981 | Barradas . | |
| 4,365,084 | 12/1982 | Fulgoni | 132/245 |
| 4,431,012 | 2/1984 | Albertoni . | |
| 4,465,084 | 8/1984 | Fulgoni . | |
| 4,516,011 | 5/1985 | Jeffress et al. . | |
| 4,638,821 | 1/1987 | Smith . | |
| 4,687,010 | 8/1987 | Caruso . | |
| 4,699,159 | 10/1987 | Thaler . | |
| 4,771,797 | 9/1988 | Kosaka . | |
| 4,989,621 | 2/1991 | Keller | 132/222 |
| 5,007,443 | 4/1991 | Fulgoni . | |
| 5,117,090 | 5/1992 | Askins . | |
| 5,144,968 | 9/1992 | Rivera . | |
| 5,255,694 | 10/1993 | Caruso . | |
| 5,263,501 | 11/1993 | Maznik . | |
| 5,286,949 | 2/1994 | Simons . | |
| 5,309,930 | 5/1994 | Presser . | |

FOREIGN PATENT DOCUMENTS

| | | |
|---|---|---|
| 32 30 357 A1 | 2/1984 | Germany . |
| 29500740 U | 1/1985 | Germany . |
| 3 616 076 | 11/1987 | Germany . |
| 18 51 705 | 11/1991 | Germany . |
| 9311823 U | 8/1993 | Germany . |
| 4 26 125 | 12/1966 | Switzerland . |
| 2 192 786 | 1/1988 | United Kingdom . |
| 88/00445 | 1/1988 | WIPO . |

HAIR CURLER

This is a CIP of application Ser. No. 08/284,095 filed Aug. 1, 1994 and now U.S. Pat. No. 5,538,021.

FIELD OF THE INVENTION

The present invention relates to a hair curler comprising a self-gripping tape to form a self-sticking curler.

Such self-sticking hair curlers have the advantage that they can be handled without a clasp, a cross-clip or another type of closure mechanism and, as such, merely consists of an approximately round body. Outwardly projecting self-gripping protrusions of a self-gripping tape placed on a curling body come directly into operative connection with the hair and retain the curler in the hair after rolling up.

It has, however, been shown to be disadvantageous that a number of curlers with different diameters are necessary to fit to a user's hair length, because the decisive factor for the tightness of the curls is the diameter of the winding member.

The same problem occurs for permanent waving making use of chemical agents which produce a softening of the cellular structure of the hair and thereafter fix the hair in an altered shape. Again the decisive factor for the tightness of the curls is the diameter of the winders.

An object of the invention is thus to provide a hair curler which can be used for different hair lengths to avoid a great number of hair curlers with different diameters.

Another object is to provide an improved hair curler which can be readily used even by unskilled individuals but which will be free from drawbacks of earlier devices.

SUMMARY

This invention provides a hair curler which exhibits a winding member with an increasable diameter using a flag-shaped length of a self-gripping strip. The flag-shaped length is rolled up together with a lock of hair providing after each turn a winding member with an increased diameter depending on the thickness of the flag-shaped length and the lock of hair in between. Since the flag-shaped length can have different lengths, the number of turns can be chosen in line with a user's hair length and the desired hair curler diameter. Consequently, there is no need of having hair curlers with different diameters. By using the hair curler according to the invention the flag-shaped length is rolled onto the winding member together with a lock of hair increasing the winding member diameter depending on the length of the flag-shaped length and the number of turns rolled onto the winding member.

Furthermore, the increasing diameter of the hair curler during curling provides more natural curls because at the beginning of the curling the winding member has a smaller diameter and at the end of the curling the diameter is greater. Consequently, the curls are more loose close to the scalp and tighter at the opposite free end. The curler thus guaranties the natural curl looking.

As a result of the increasable diameter storage problems are minimized.

The hair curler according to the invention can be used as well as a permanent wave winder and represents a device which is simple and uncomplicated and which can be mastered not only by specialist hairdressers, but also by domestic users. The hair curler calls for no new technology and is used in precisely the same way as the prior art hair curlers.

According to the invention the flag-shaped length is preferably of the same width as the winding member and whose length corresponds to the desired diameters for obtaining tight or soft curls depending on the length of the treated hair.

The hair to be treated is wound on in the usual manner, the flag-shaped length being wound on together therewith. The excess length of the flag-shaped length can simply be cut off.

The good retaining force of the curler is achieved by use of a self-gripping tape having projecting hooks, pins or bristles. Said attachment protrusions are preferably formed by cut-open loops of a nylon monofilament, thus resulting in hooks. Said hooks may be deformed to mushroom-like bristles by heat process. Such a type with mushroom-like bristles likewise has advantages in self-gripping properties.

A further advantage of the hair curler according to the invention is the use of only one piece of a flat strip defining the winding member and the flag-shaped length making the production of those hair curlers much cheaper.

Further embodiments and advantages of the invention are given in the claims and the following description.

BRIEF DESCRIPTION OF THE DRAWINGS

The invention is explained in more detail here below with reference to the exemplary embodiments represented in the attached drawings in which.

DETAILED DESCRIPTION

Figure 1:
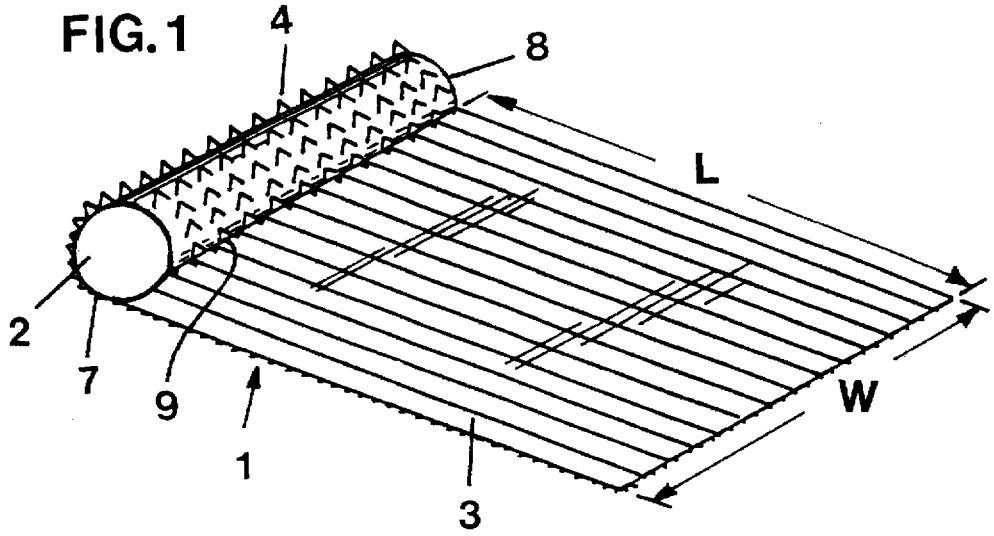
FIG. 1 shows schematically a perspective side-view of a first preferred embodiment of a hair curler.
Figure 2:
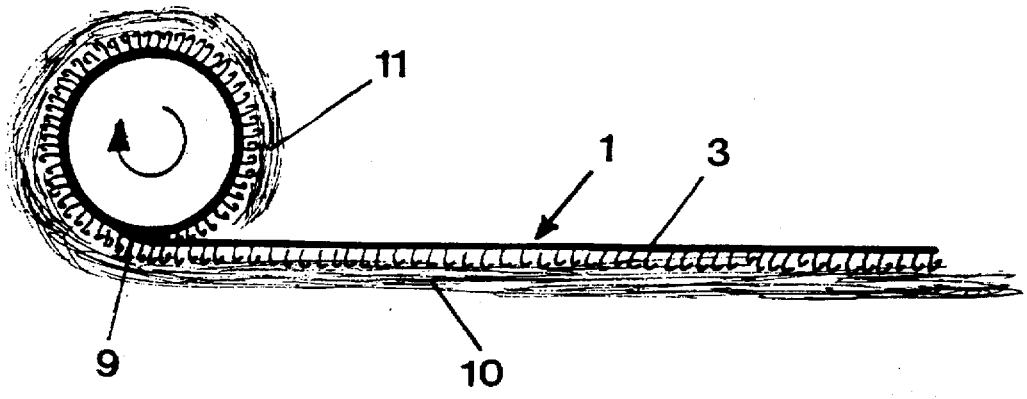
FIG. 2 shows schematically another side-view of the first preferred embodiment.

The curler represented in FIGS. 1 and 2 is a self-sticking curler comprising a flat strip of relatively stiff self-gripping tape 1 forming a winding member 2 and having a flag-shaped length 3 extending from the winding member 2.

The winding member 2 is no actual seperate spool, but is formed by an initial turn or turns of the flat strip 1. For this purpose the strip is made of a relatively stiff material.

The outside of the strip 1 is provided with outwardly projecting protrusions 4 so that the strip 1 is in the form of a self-gripping tape. The protrusions 4 are distributed on the outside creating a hook-type band. The protrusions 4 may be formed by cut-open loops of a nylon monofilament or by a mushroom-like configuration which may be achieved by a mushroom-like deformation of the hooks using heat. In the first embodiment the protrusions 4 are distributed along the whole width of the strip 1 while in a second embodiment (FIG. 3) the protrusions 4 cover the outside only in a central region while uncovered portions 6 are arranged along the lateral edges.

The flag-shaped length 3 is usually one piece with the winding member 2. An initial turn forms the winding member 2 by sealing a front edge of the strip 1 onto the strip 1 after the initial turn.

The strip 1 is made of a plastic material being provided with openings 19 to be permeable to air and liquids. Preferably the strip 1 is a fabric with tied-in protrusions 4. The plastic material for the strip 1 can be chosen in such a way that the hair curler can be used for permanent waving. Alternatively, the strip 1 can be impermeable to liquids using a coating or lamination with thermoplastic foil on the rear side. Further, the strip 1 can be in a form of a composite foil.

The flag-shaped length 3 has preferably the same width like the winding member and projects laterally from an attachment line 9 which extends between the two ends 7, 8 of the winding member 2. The flag-shaped length 3 of the strip 1 has, as a rule, a greater length L than width W, to enable a sufficiently long tape zone to be rolled onto the winding member 2. The length L of the flag-shaped length 3 can be shortened as required. Preferably the flag-shaped length 3 projects laterally beyond the initial winding member 2 to envelope said winding member 2 at least one time.

Figure 4:
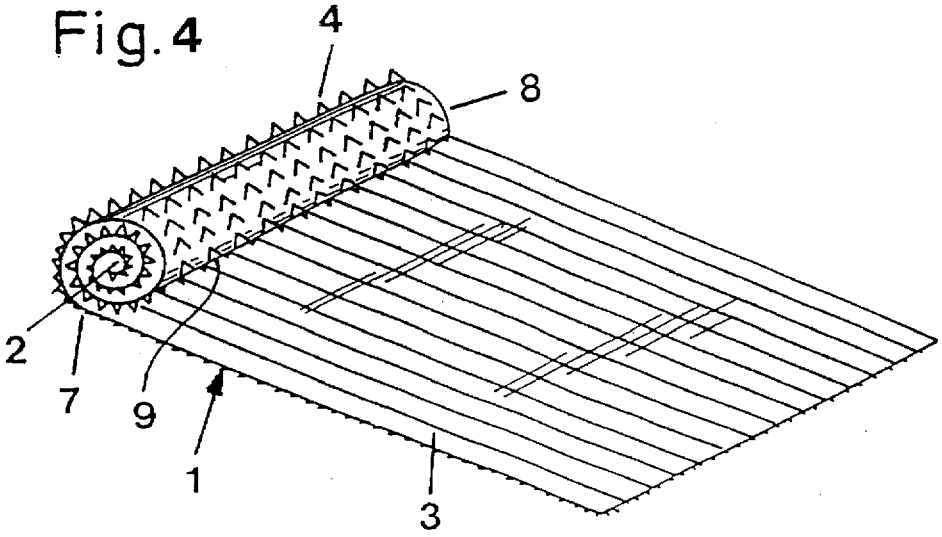
FIG. 4 shows schematically a perspective side-view of a third preferred embodiment of a hair curler.

In the embodiment as illustrated in FIG. 4, the strip 1 forms a roll of relatively stiff self-gripping tape 1 which takes over forms a roll of relatively stiff self-gripping tape 1 which takes over the complete function of the hair curler comprising a winding member 2 and flag-shaped length 3.

Figure 3:
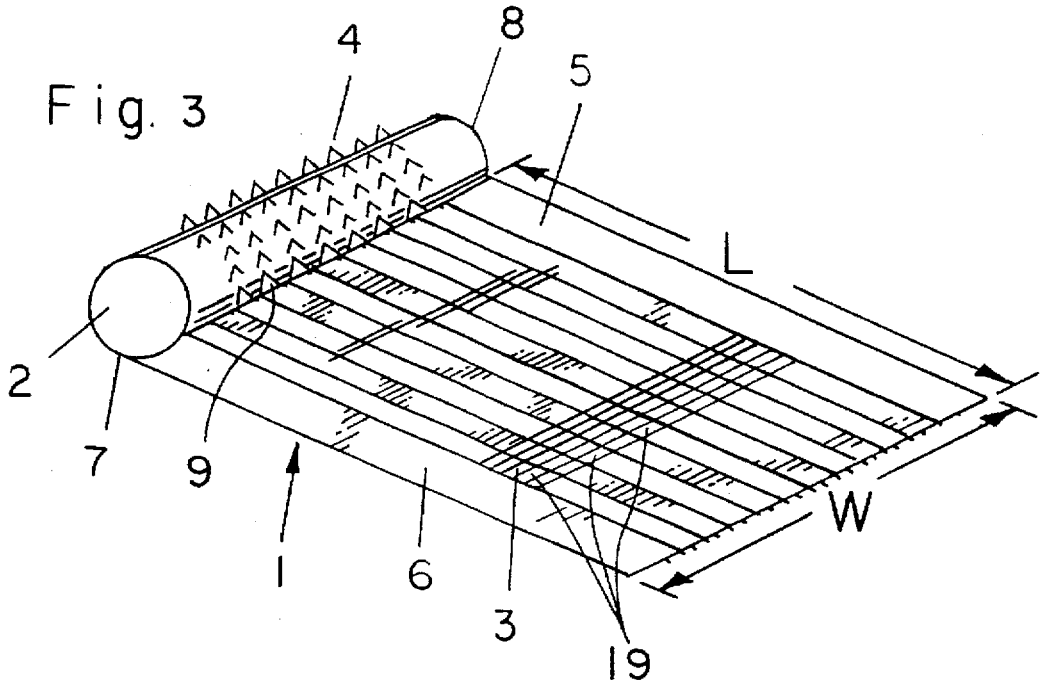
FIG. 3 shows schematically a perspective side-view of a second preferred embodiment of a hair curler.

In the case of the hair curler of FIGS. 1 and 3, a lock of hair to be treated 10 (see FIG. 2) is placed on winding member 2 which is coiled to wind the free end 10 of the lock of hair inwardly of the flag-shaped length 3, so that with continued rolling the hair 10 comes always on top of the outside of the flag-shaped length 3 being covered with the protrusions 4 until the flag-shaped length 3 ends. The received diameter of such a curler with rolled on tape 3 and hair 10 defines a curler diameter onto which the remaining lock length is rolled, the retention of the hair curler is effected by the protrusions 4 avoiding fasteners or rubber bands to retain the curlers in place.

In the case of the hair curler of FIG. 4 a lock of hair is rolled in an identical way except that the initial turn has no fixed diameter by sealing an initial turn or turns to the strip 1, but can be individually chosen to get loose or tight curls. After the hair curlers are placed over the entire head as may be desired, the hair can be heated or treated with a permanent waving solution.

The invention now being fully described, it will be apparent to one of ordinary skill in the art that many changes and modifications can be made thereto without departing from the spirit of scope of the appended claims.

I claim:

1. A hair curler comprising:

a winding member onto which a lock of hair can be wound; and a strip of foil being composed at least in part of relatively stiff self-gripping tape having at least one turn forming said winding member and a flag-shaped length, said flag-shaped length being attached to said winding member along an attachment line extending between two ends of said winding member so that said flag-shaped length can be wound onto said winding member together with the lock of hair.

2. The hair curler according to claim 1 wherein said strip of foil is formed by a self-gripping tape provided with openings to be permeable to air and liquids and with outwardly projecting elements on an outside, said elements selected from the group consisting of hooks and bristles.

3. The hair curler according to claim 2 wherein the flag-shaped length of said strip is attached to said winding member in such a way that the flag-shaped length can be wound onto said winding member with the outside being a hair facing side for the winding.

4. The hair curler according to claim 2 wherein a rear side of said self-gripping tape further comprises a layer of thermoplastic foil rendering said tape impermeable to liquids.

5. The hair curler according to claim 4 wherein the self-gripping tape is in a form of a composite foil.

6. The hair curler according to claim 1 wherein said one turn of said self-gripping tape is fixed by sealing one edge of said strip to an attachment line of said flag-shaped length.

7. The hair curler according to claim 6 wherein said one turn of said self-gripping tape and said flag-shaped length are formed in one piece of said strip.

8. The hair curler according to claim 2 wherein said self-gripping tape has one or more external zones free from said outwardly projecting elements.

9. A hair curler having a winding member onto which a lock of hair can be wound, the winding member being formed by a relatively stiff self-gripping tape with outwardly projecting protrusions on an outside, said tape being wound together with a lock of hair engaging said front-side of the tape which defines a hair facing side for the winding.

10. The hair curler according to claim 9 wherein a rear side of said self-gripping tape further comprises a layer of thermoplastic material rendering said tape impermeable to liquids.

* * * * *